US007905035B2

(12) United States Patent
Thomas

(10) Patent No.: US 7,905,035 B2
(45) Date of Patent: Mar. 15, 2011

(54) CORRUGATED CLEARING BAR

(75) Inventor: Juergen Thomas, Dortmund (DE)

(73) Assignee: Gummi Kueper GmbH & Co. KG, Bochum (DE)

( * ) Notice: Subject to any disclaimer, the term of this patent is extended or adjusted under 35 U.S.C. 154(b) by 39 days.

(21) Appl. No.: 12/227,194

(22) PCT Filed: May 8, 2007

(86) PCT No.: PCT/EP2007/004035

§ 371 (c)(1),
(2), (4) Date: Jan. 28, 2009

(87) PCT Pub. No.: WO2007/131663

PCT Pub. Date: Nov. 22, 2007

(65) Prior Publication Data

US 2009/0320332 A1 Dec. 31, 2009

(30) Foreign Application Priority Data

May 11, 2006 (DE) ..... 10 2006 021 910

(51) Int. Cl.
*E02F 3/00* (2006.01)
*E01H 5/06* (2006.01)

(52) U.S. Cl. ..... 37/266; 172/701.3

(58) Field of Classification Search ..... 37/266, 37/264, 233, 446, 460; 172/701.1–701.3, 172/719, 772, 772.5
See application file for complete search history.

(56) References Cited

U.S. PATENT DOCUMENTS

| | | | | |
|---|---|---|---|---|
| 1,944,307 | A | 1/1934 | Spoon | |
| 3,545,109 | A | 12/1970 | Boschung | |
| 3,934,654 | A * | 1/1976 | Stephenson et al. | 172/701.3 |
| 5,054,217 | A * | 10/1991 | Nilsson et al. | 37/244 |
| 5,309,653 | A | 5/1994 | Pease et al. | |
| 5,471,770 | A * | 12/1995 | Ferreira | 37/264 |
| 5,743,032 | A * | 4/1998 | Vauhkonen | 37/446 |
| 2007/0193755 | A1 | 8/2007 | Kuper | |

FOREIGN PATENT DOCUMENTS

| | | |
|---|---|---|
| DE | 1 959 940 | 5/1967 |
| DE | 81 29 044 | 3/1982 |
| DE | 30 38 121 | 4/1982 |
| DE | 87 07 182 | 8/1987 |
| DE | 44 04 969 | 8/1995 |
| DE | 296 22 102 | 2/1997 |
| DE | 299 01 383 | 6/1999 |
| DE | 101 47 393 | 4/2003 |
| DE | 10 2004 029 165 | 12/2008 |
| EP | 0 284 582 | 9/1988 |
| EP | 1 524 368 | 4/2005 |
| WO | WO 95/23894 | 9/1995 |

OTHER PUBLICATIONS

International Search Report.

* cited by examiner

*Primary Examiner* — Robert E Pezzuto
(74) *Attorney, Agent, or Firm* — Collard & Roe, P.C.

(57) ABSTRACT

A clearing bar for the clearing blade of a snow plough, is defined at least partially in cross section by a curved contour and avoids undesirable swirling of snow within the clearing blade Snow is swirled on parts of the fastener for fastening the clearing bar to the clearing blade. To solve this problem, a design of the curved contour is optimized dynamically in terms of flow.

13 Claims, 5 Drawing Sheets

CORRUGATED CLEARING BAR

CROSS REFERENCE TO RELATED APPLICATIONS

This application is the National Stage of PCT/EP2007/004035 filed on May 8, 2007, which claims priority under 35 U.S.C. §119 of German Application No. 10 2006 021 910.4 filed on May 11, 2006. The international application under PCT article 21(2) was not published in English.

BACKGROUND OF THE INVENTION

1. Field of the Invention

The present invention relates to a clearing bar for the clearing blade of a snowplow, which is provided, at its end facing away from the road to be cleared, with an essentially planar attachment neck, which is intended for being grasped by attachment means and fixed in place on the clearing blade, whereby at least parts of the attachment means rise out of the plane of the attachment neck in the direction of travel, and whereby the cross-section of the clearing bar is delimited, at least in the region of the attachment means, by a curved contour, which passes through an apex that lies outside of the plane between road and attachment neck.

2. The Prior Art

Such a clearing bar is known from the utility model DE 81 29 044 U1 and from the patent DE 44 04 969 B4 of the same applicant.

The clearing bar is a wear part that is affixed to the road-side end of the clearing blade of a snowplow. The clearing bar is pressed onto the asphalt, scrapes the snow from the road, and passes it into the clearing blade, which pushes the collected snow to the side.

A usual clearing bar according to the state of the art is shown in FIG. 1. The curved clearing blade 1 of a snowplow is guided along the road 2 in the direction of travel F. A clearing bar 3 is affixed to the road-side, lower end of the clearing blade 1, with which the clearing blade 1 presses down against the road 2. At its upper end, the clearing bar 3 has an essentially planar attachment neck, with which the clearing bar 3 is attached to the clearing blade 1. Attachment takes place using attachment means 5 that grasp the clearing bar in the region of the attachment neck 4 and fix it in place on the clearing blade 1. The attachment means 5 are generally screws (as shown in FIG. 1 and in the case of DE 81 29 044 U1) or clamping claws that grasp the clearing bar over a large area and press it against the lower end of the clearing blade 1. DE 30 38 121 A1 shows clamping claws. Furthermore, special attachment means are known, for example from DE 101 47 393 A1 of the same applicant.

When it is advanced in the direction of travel F, the clearing bar 3 loosens snow 6 that is lying in the road 2, and passes it upward in the direction of the curved clearing blade 1. Particularly in the case of snow removal trips on highways, which are carried out at speeds above 40 km/h, not insignificant snow turbulences within the clearing blade occur; offshoots of these turbulences can reach the windshield of the clearing vehicle and can cover it with snow. The driver's vision is significantly restricted by this. In the patent literature, some references are known that concern themselves with keeping the snow turbulence that forms in the clearing blade away from the windshield. Examples that can be named in this regard are U.S. Pat. No. 5,309,653 and DE 299 01 383 U1.

These two references describe great apparatus effort for limiting the effects of the snow turbulence that occurs in the clearing blade. However, they do not recognize and treat the actual cause of the problem. This can be seen in the parts of the attachment means that rise out of the plane of the attachment neck. These parts—in FIG. 1, the screw head 7—represent a flow resistance on the clearing bar 3, which is otherwise planar. The snow 6 that is taken up is swirled up in a turbulence zone 8, directly below the screw head 7, so that a highly turbulent flow of snow occurs in the clearing blade 1, offshoots of which cover up the windshield, unless suitable interception devices are provided.

Even though screw heads, in particular, take up only a small proportion of the total width of a clearing bar, studies by the applicant have shown that even these small flow resistances at the transition between clearing bar and clearing blade exert a significantly negative influence on the flow of snow within the clearing blade. When using clamping claws, this problem occurs to an even more unpleasant extent. This holds true not only for clearing bars having a completely planar front, such as the example shown in FIG. 1, but also for clearing bars having a curved contour, in cross-section, as they are known from DE 81 29 044 U1 or DE 44 04 969 B4. As long as the contour is curved in the manner disclosed there, the flow of snow is also guided past the attachment means, and for this reason, turbulence occurs here, as well.

From the German utility model DE 1 959 940 U1, a clearing blade having a clearing bar made of a resilient material is known. The clearing bar has a flat, block-shaped form when not in use; in clearing operation, it is pressed against the road by the clearing blade, and is greatly deformed in this process. In the deformed state, its cross-section is partly delimited by a curved contour that makes a transition into a linear section, in a projecting corner point. The corner point results from the edge between front side and narrow side of the non-deformed clearing bar. The flow of the snow breaks off, in uncontrolled manner, as a result of the non-constant transition of the linear section into the curved contour, so that the snow is swirled up in diffuse manner here. Furthermore, the corner point is comparatively far removed from the projecting part of the attachment means, so that the flow of snow is broken up again by the attachment means, after it has swirled around the corner point.

DE 296 22 102 U1 pursues the goal of disposing the attachment means on the back of the clearing bar, to the greatest possible extent, in order to put up as little resistance as possible to the flow of the snow masses that is directed upward. This does not succeed completely, since clamping screws are required for the solution proposed there, whose heads continue to have the snow masses flow around them. For the remainder, it is also pointed out that flow resistances lead to turbulences in and above the clearing blade that impair vision.

WO 95/23894 A1 describes a snow plow whose clearing bar is mounted in the clearing blade so as to pivot. The clearing bar itself is planar and connected with a carrier plate without any projecting parts of an attachment means, possibly by means of gluing, welding, or vulcanization. A flexible rubber flap, which is curved during clearing operation, closes off the movement region of the clearing bar in the clearing blade. Due to the absence of projecting parts, undisturbed flow of the snow from the clearing bar into the blade should be expected. However, this is achieved at the price of incompatibility of the clearing bar with conventional plows. Furthermore, replacement of this clearing bar after it has become worn is significantly more complicated, because of its material-fit connection with the articulated mounting.

SUMMARY OF THE INVENTION

In view of the state of the art, the present invention is based on the task of further developing a clearing bar for the clearing blade of a snowplow, in such a manner that turbulent flow within the clearing blade is avoided, to the greatest possible extent, in order to thereby prevent vision-impairing snow drifting in the region of the windshield of the clearing vehicle, without additional apparatus effort. Furthermore, it should be possible to install the clearing bar being aimed at on existing snowplows, in place of a conventional clearing bar, without additional effort, in similar manner.

The solution for this problem is based on the recognition that turbulences are caused by flow resistances on projecting parts of the attachment means in the transition region between clearing bar and clearing blade. In terms of design, it is proposed to configure the clearing bar in such a manner, in terms of flow dynamics, that the snow flow that shoots up flows past the projecting parts of the attachment means in as laminar a manner as possible.

This is achieved with a clearing bar of the type stated initially, in which the tangent at the contour at the apex is oriented parallel to the plane of the attachment neck, and in which the tangent at the contour at a point adjacent to the apex, which lies between the road and the apex, penetrates the plane of the attachment neck.

The present invention is based on the fundamental idea of optimizing the clearing bar in terms of flow dynamics, so that snow turbulences do not even occur. For this purpose, the curved contour is modified in such a manner that its tangent at the apex is oriented parallel to the plane of the attachment neck. Furthermore, the curved contour must be configured in such a manner that at a point adjacent to the apex, which lies below the latter, a tangent that is not parallel to the plane of the attachment neck lies against the contour. The tangent at the adjacent point goes past the projecting part. In this manner, the contour of the clearing bar is given a sort of "wave-shaped profile." The snow that flows along the clearing bar breaks off in the region of the adjacent point, flows over the projecting parts of the attachment means in laminar manner, to the greatest possible extent, and is collected in the clearing blade. In this way, turbulence is precluded, to the greatest possible extent.

At its core, the invention concerns itself with the shape of the cross-section of the clearing bar. The cross-section configured according to the invention has the following geometrical characteristics: It is delimited by a curved contour, at least in sections. This curved contour passes through an apex. The apex lies outside of the plane of the attachment neck of the clearing blade. At the apex, precisely one tangent lies against the curved contour. This tangent runs parallel to the plane, in other words, the tangent at the apex has no point in common with the plane. Directly next to the apex, the curved contour runs through an adjacent point. This lies between the road and the apex. At the adjacent point, precisely one tangent lies against the curved contour. The tangent through the adjacent point penetrates the plane, in other words the tangent at the adjacent point has precisely one point in common with the plane.

The wave-shaped profile according to the invention does not have to be maintained over the entire length of the clearing bar. It is fundamentally sufficient to provide it merely in the region of the attachment means. However, the geometry of the clearing bar becomes more complex as a result; the contour changes over its length; different cross-sections occur. In the interest of production costs, it is therefore recommended to maintain the contour according to the invention over the entire length of the clearing bar.

The shielding effect of the apex is particularly effective if the apex is brought as close as possible to the projecting part of the attachment means. Geometrically, this is achieved if the plumb point of the apex in the plane has a slighter distance from the projecting part of the attachment means than from the intersection of the plane with the road. The stated distances are understood to be measured within the plane, in each instance. As the result of wear of the clearing bar, the apex "migrates" in the direction of the road; the distance of the apex from the intersection decreases over the useful lifetime of the clearing bar. Consequently, the wear limit of the clearing bar is reached approximately when the distance of the apex from the road is less than from the projecting part.

The turbulence-free flow of the snow into the clearing blade also has a positive effect on snow removal: The sliding behavior of the clearing bar is improved, the snow is thrown slightly in the direction of travel by the wave-shaped profile, and therefore flows away better to the side in the clearing blade. The clearing resistance is reduced, as a result, and the power demand of the clearing vehicle decreases.

This effect is particularly effective if the apex is situated in front of the plane, or even better in front of the parts of the attachment means that rise from the plane of the attachment neck. "In front of" is understood to mean, here, ahead in the direction of travel. Fundamentally, it is possible to dispose the apex behind the plane of the attachment neck, too. In this case, the contour has a convex curvature at the apex. Then, however, the flow of snow must be accelerated above the apex, in the direction of travel, beyond the plane of the attachment neck, and this means a relatively great loss of energy. The configuration of the invention according to claims 2 and 3, on the other hand, provides for a concave contour in the region of the apex, which is clearly more advantageous in terms of flow dynamics.

As mentioned initially, the clearing bar is a wear part that wears off at its road-side end. In the case of clearing bars known from the state of the art—cf. FIG. 1 and DE 81 29 044 U1—a constant contact surface is provided in the entire wear region of the clearing bar. The contour curved according to the invention is accompanied by a varying thickness in the clearing bar over the wear region, in the direction of travel, which leads to non-uniform wear. In order to compensate this, it is proposed to configure the contour in linear manner below the apex. To balance out a corrugated contour progression on the front, it is also possible to provide a bottom point on the back of the contour, the tangent of which is oriented parallel to the plane of the attachment neck.

The clearing bar that has been optimized in terms of flow dynamics is preferably produced from rubber. Since the rubber surface is too soft for the abrasive flow of snow, it is recommended to reinforce the contour of the clearing bar, at least in sections, with steel. This is then a so-called sandwich clearing bar made of rubber and steel.

It is practical if a hard-material body is embedded into the rubber. This hard-material body slows down the wear of the clearing bar on the road. The hard-material body can optionally be structured as a ceramic shaped body or as a hard-metal core surrounded by a steel mantle. The ceramic shaped body has the advantage that it can be produced by means of a sintering process, which allows great freedom of configuration with regard to the contour of the shaped body. Thus, it is possible to have the contour of the shaped body run parallel to the contour of the clearing bar, so that the proportion of ceramic in the wear surface always remains constant. The sintering process of the hard-metal core does not allow this, so that here, a linear contour has to be accepted. A clearing bar that is not optimized in terms of flow dynamics, having a hard-metal core, is described by the applicant in its Offenlegungsschrift [examined patent application published for public scrutiny] DE 10 2004 029 165 A1.

Alternatively to the rubber embodiment or sandwich embodiment, the invention can also be implemented as a solid steel clearing bar.

BRIEF DESCRIPTION OF THE DRAWINGS

The present invention will now be explained in greater detail, using exemplary embodiments. For this purpose, the figures show.

DETAILED DESCRIPTION OF THE PREFERRED EMBODIMENTS

Figure 2:
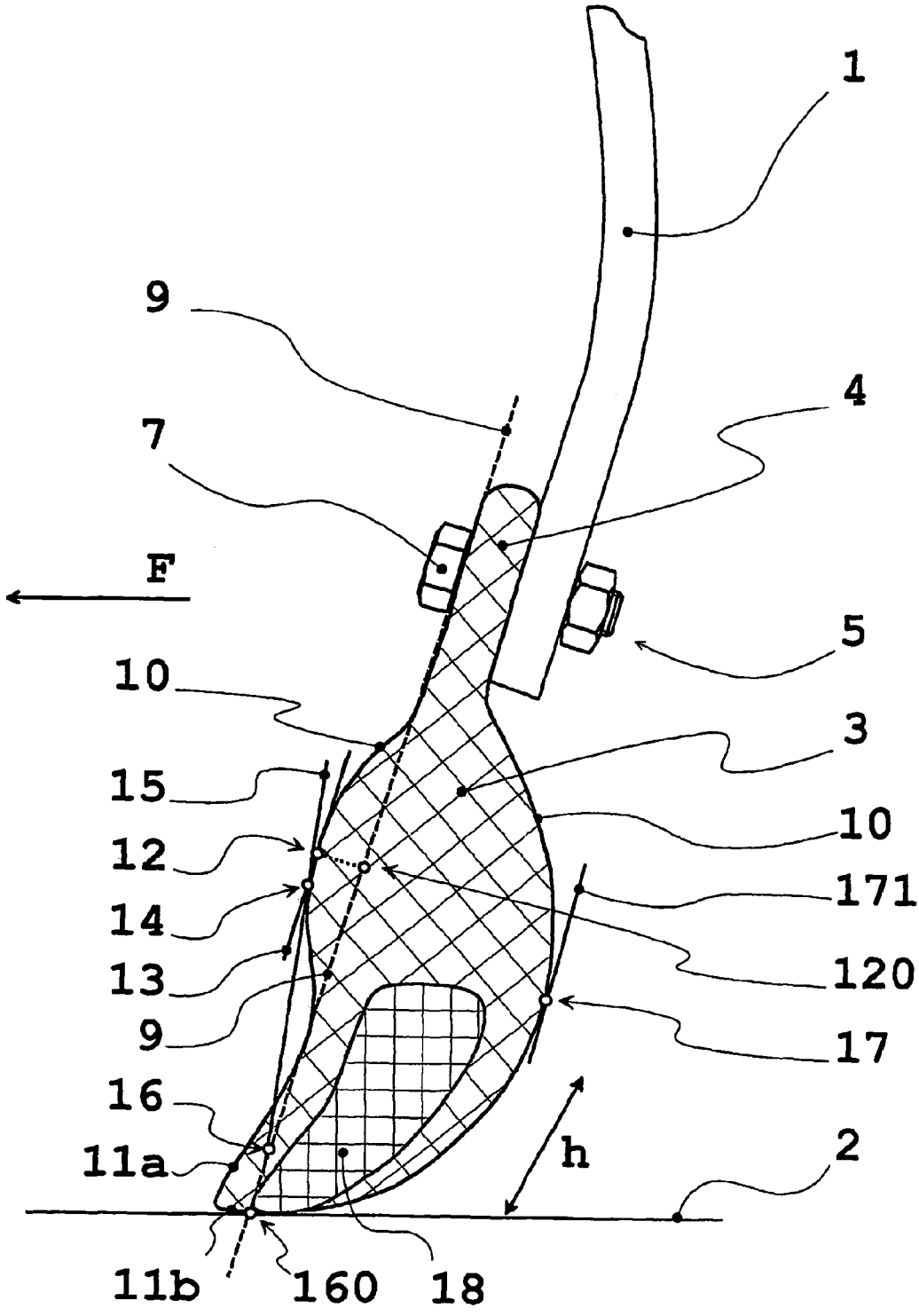
FIG. 2: clearing bar according to the invention, in cross-section.
Figure 2X:
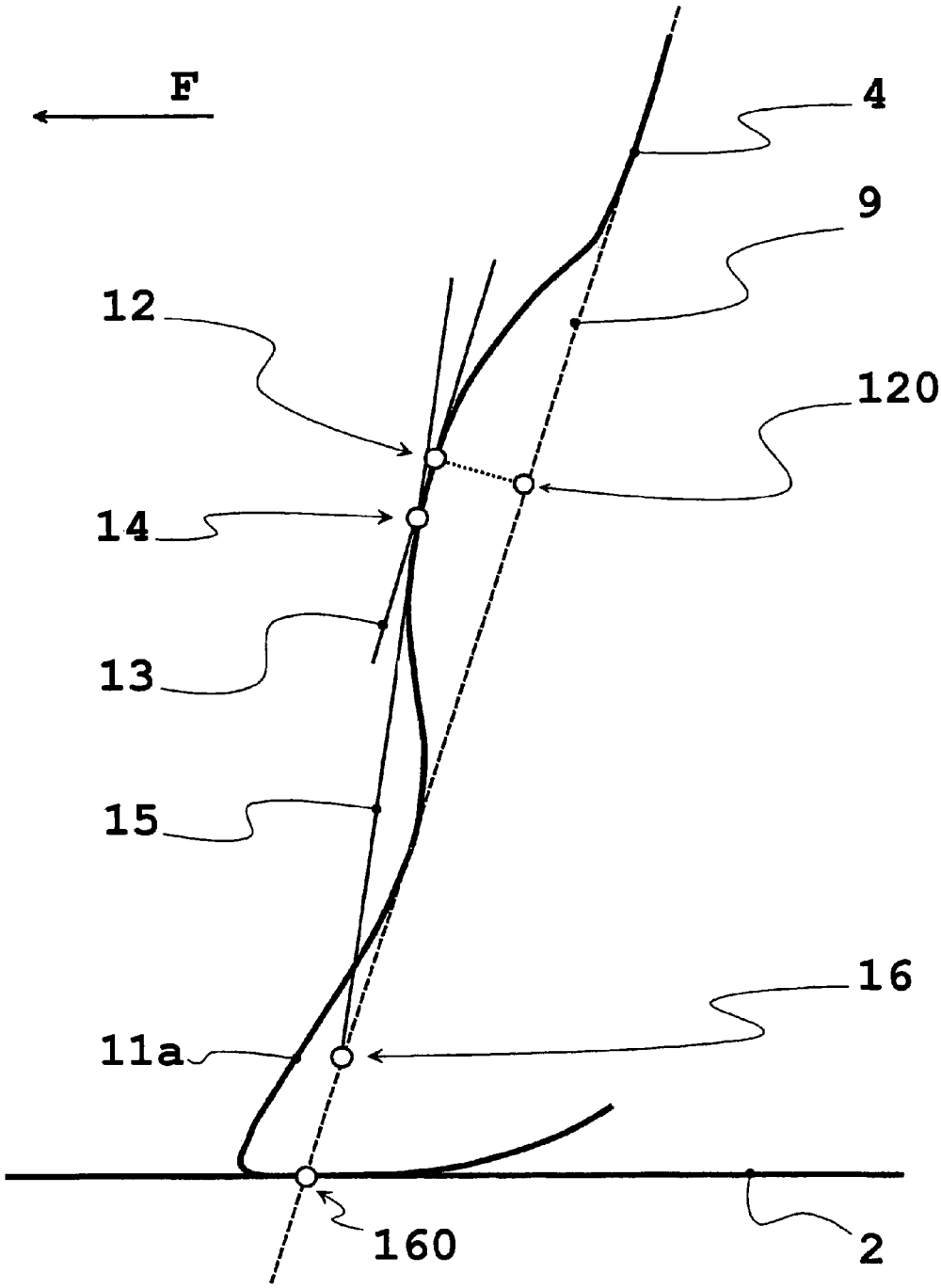
FIG. 2*x*: enlargement of FIG. 2 in the region of the apex.

The clearing bar 3 shown in FIG. 2, according to the invention, is fixed in place on the road-side end of a clearing blade 1, using existing attachment means 5, on the attachment neck 4, in place of a conventional clearing bar. The attachment neck 4 consequently forms the end of the clearing bar 3 that faces away from the road 2 to be cleared. Seen from the front, the planar attachment neck 4 extends within an imaginary plane 9. Due to the principle, parts 7 of the attachment means 5 project out of the plane 9 in the direction of travel F, in order to be able to grasp and fix the attachment neck 4 in place. In FIG. 2, the attachment means are structured as a simple screw connection. The part 7, which rises out of the plane 9, is a screw head 7. Likewise, parts of a clamping claw or a special attachment can project.

The cross-section of the clearing bar 3 shown in FIG. 2 is delimited by a contour that comprises curved and linear sections. The contour is structured as a curved contour 10 over almost its entire circumference; only in the region of the plane 9 of the attachment neck 4 and at its road-side end is the curved contour 10 replaced with linear sections 11*a*, 11*b*, which will be explained in greater detail below. The curvature of the curved contour 10 can be described mathematically, using tangents, which lie against the contour 10 at one point, in each instance.

Between road 2 and attachment neck 4, the curved contour 10 has an apex 12; here, the related tangent 13 extends parallel to the plane 9 of the attachment neck 4. Directly below the apex 12, in the direction of the road 2, there is an adjacent point 14, the tangent 15 of which penetrates the plane 9 at a penetration point 16 below the apex 12. The adjacent point 14 lies at an infinitesimal distance below the apex 12. Since this can hardly be shown in a drawing, and the penetration point 16 would lie very far outside of the plane of the drawing, the adjacent point 14 is shown moved a bit farther down. In the exemplary embodiment shown, the contour 10 has a concave curvature at the apex. In the case of a convex curvature in the sense of the invention, the penetration point 16 would lie above the apex 12.

Figure 1:
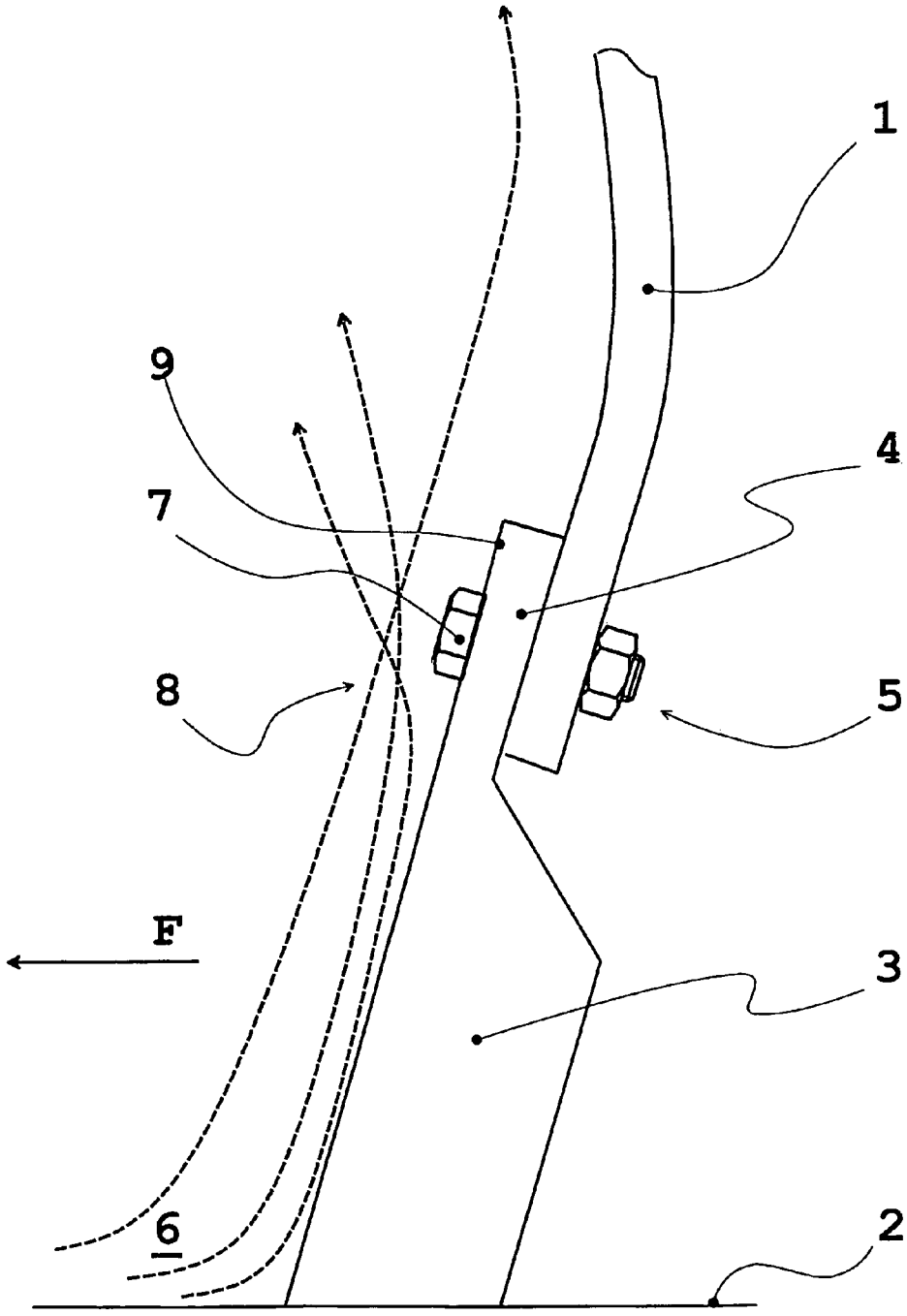
Fig. 1 Prior Art
FIG. 1: conventional clearing bar in cross-section (state of the art)

In accordance with the concave curvature, the apex 12 lies in front of the imaginary plane 9 in the case of the exemplary embodiment of FIG. 1, seen in the direction of travel. Its perpendicular distance from the plane 9 has been selected to be so great that it rises above the parts 7 that project from the plane 9. By dropping a plumb line from the apex 12 to the plane 9, the imaginary plumb point 120 is found. The distance of the plumb point 120 from the screw head 7 is smaller, measured in the plane 9, than the distance of the plumb point 120 from the imaginary intersection 160 of the plane 9 with the road 2. As a result of this constellation, the screw head 7 is situated comparatively close to the apex.

In its region near the road, the clearing bar 3 has two linear sections 11*a*, 11*b*, a first 11*a* approximately perpendicular to the direction of travel F, a second 11*b* parallel to the asphalt surface of the road 2. The first linear region 11*a* extends over the preferred wear region h of the clearing bar. It serves to scrape the snow off the road and transport it in the direction of the curvature in the region of the apex 12. The second linear section 11*b* serves as a contact surface of the clearing bar 3, and is constantly ground down.

On the back of the clearing bar 3, its contour 10 passes through a bottom point 17, the tangent 171 of which also runs parallel to the plane 9 of the neck region 4. From the second linear section 11*b* to the bottom point 17, the contour 10 describes a curvature that ensures an approximately uniform axial thickness of the clearing bar 3 over the preferred wear region h, so that the most uniform wear possible is guaranteed. It is also possible to move the clearing bar 3 beyond the preferred wear region h, in an extreme case all the way to the road-side start of the attachment neck 4. However, the effect according to the invention is lost as soon as the clearing bar 3 has been worn off beyond the apex 12.

In its interior, the clearing bar 3 consists of rubber that is reinforced, at the contour, with steel that has been vulcanized on (not shown). In the wear region h, a hard-material body 18 is embedded, the contour of which runs essentially parallel to the contour 10 of the clearing bar 3 in this region. An unfired ceramic hard-material body can be shaped accordingly, and then sintered. The hard-material body 18 can extend over the entire length of the clearing bar 3, or a plurality of column-like hard-material bodies can be embedded in the clearing bar 3, one next to the other.

Figure 3:
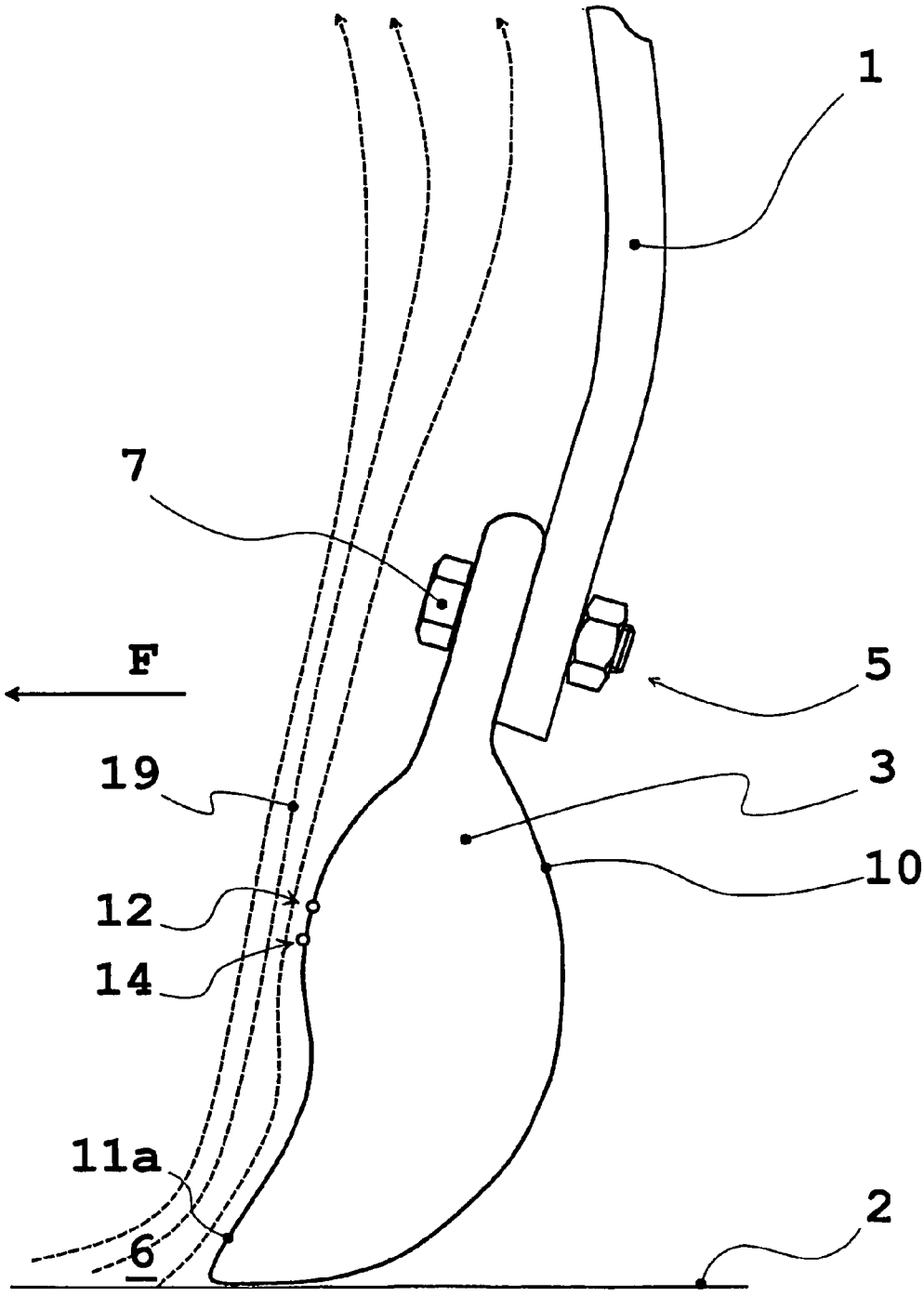
FIG. 3: flow behavior of the clearing bar from FIG. 2.

The flow behavior of the clearing bar according to the invention, from FIG. 2, is shown in FIG. 3. The snow 6 that is lying on the road 2 is loosened by a first linear section 11*a* and accelerated in the direction of the apex 12. Since the contour of the clearing bar behind the apex 12 drops in the direction of the attachment neck 4, the flow 19 of snow maintains its flow direction parallel to the plane 9 here, and flows past the projecting parts 7 of the attachment 5, without being swirled up there. In the clearing blade 1, it is deflected to the side accordingly. From the linear section 11*a* to the attachment neck 4, the corrugated section of the contour forms a hump, which is advantageous for flow, in the region of the apex 12, and the projecting parts 7 of the attachment means 5 lie in its "snow shadow." Thus, turbulence or spraying of the snow is effectively avoided.

Figure 4:
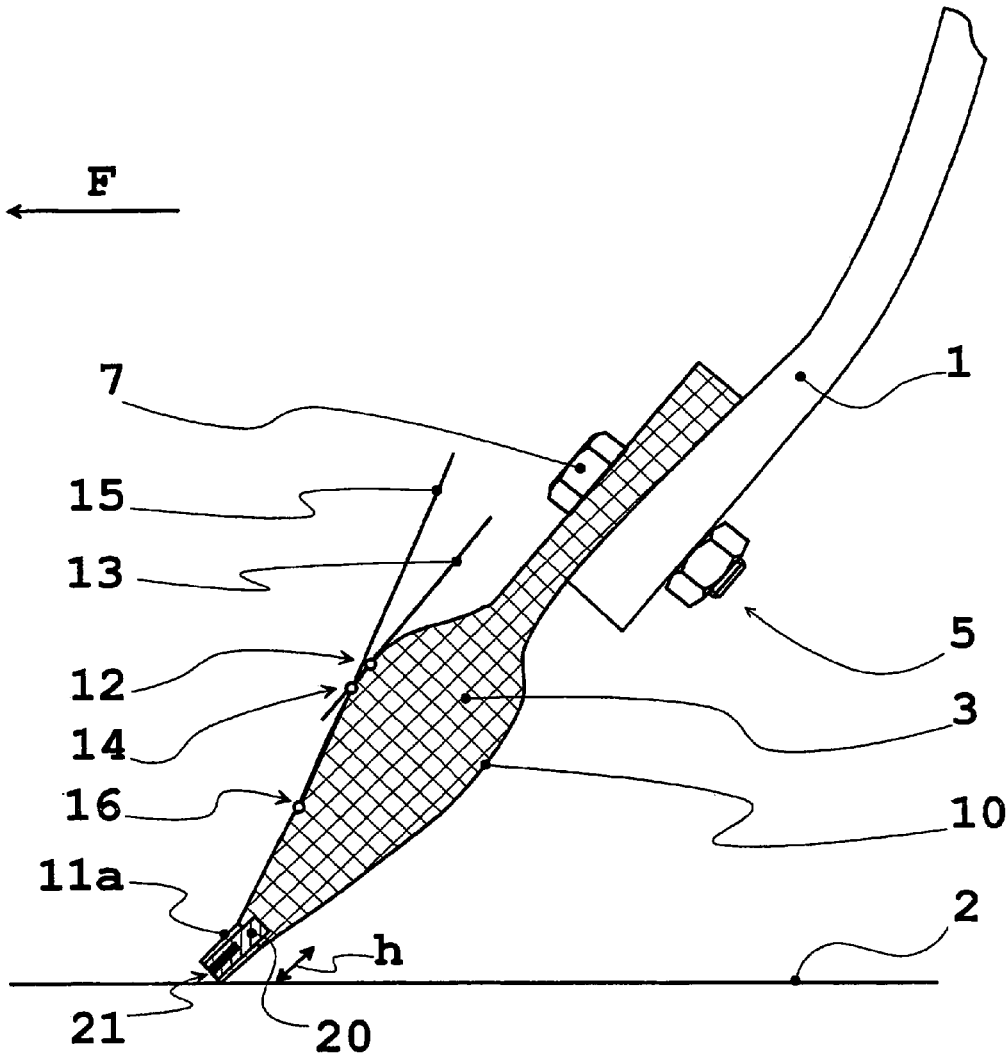
FIG. 4: second embodiment of a clearing bar according to the invention, in cross-section.

FIG. 4 shows a second embodiment of the clearing bar according to the invention. This has a symmetrical structure, to the greatest possible extent, and has a particularly long linear section 11*a* in the preferred wear region h, in which a hard-material body 18 made of a hard-metal core 21 surrounded by a steel mantle 20 is situated. Since the contour of the hard-metal core cannot assume just any desired free-form surface, its contour is essentially linear and extends parallel to the linear section 11*a* in the preferred wear region h.

The invention claimed is:

1. A clearing bar for a clearing blade of a snowplow, the clearing bar comprising:

(a) an attachment neck for connection of the clearing bar to the clearing blade at an upper end of the clearing bar, the attachment neck being essentially planar in a plane;

(b) a first curved contour on a front face of the clearing bar, the first curved contour having an apex lying outside of the plane of the attachment neck, wherein a first tangent of the first curved contour at the apex is parallel to the plane of the attachment neck, wherein a second tangent of the first curved contour at a point adjacent the apex penetrates the plane of the attachment neck, wherein the apex has a plumb point in the plane of the attachment neck, wherein a first distance between the plumb point and an area of the attachment neck for accommodating an attachment member is smaller than a second distance between the plumb point and an intersection point of the plane of the attachment neck and a lowermost plane of the clearing bar, and wherein the apex is at least aligned in a vertical manner with the area of the attachment neck for accommodating an attachment member.

2. The clearing bar according to claim 1, wherein the clearing bar is comprised of steel.

3. The clearing bar according to claim 1, wherein the apex is situated in front of the plane of the attachment neck.

4. The clearing bar according to claim 1, wherein the clearing bar is comprised at least partially of rubber.

5. The clearing bar according to claim 1, further comprising a linear section on the front face, wherein a cross-section of the clearing bar between the first curved contour and a lowermost point of the front face is delimited by the linear section.

6. The clearing bar according to claim 1, further comprising a back face of the clearing bar having a second curved contour between the attachment neck and a lowermost point of the clearing bar, wherein the second curved contour passes through a bottom point situated behind the plane of the attachment neck, and wherein a third tangent at the second curved contour at the bottom point is oriented parallel to the plane of the attachment neck.

7. The clearing bar according to claim 4, wherein the first curved contour of the clearing bar is reinforced with steel.

8. The clearing bar according to claim 4, further comprising at least one hard-material body embedded in the rubber.

9. The clearing bar according to claim 8, wherein the at least one hard-material body is a hard-metal core surrounded by a steel mantle.

10. The clearing bar according to claim 8, wherein the at least one hard-material body is a ceramic shaped body having a ceramic contour running parallel to the first curved contour of the clearing bar.

11. An assembly comprising:

(a) a clearing bar for a clearing blade of a snowplow, the clearing bar comprising:

(1) an attachment neck for connection of the clearing bar to the clearing blade at an upper end of the clearing bar, the attachment neck being essentially planar in a plane; and (2) a first curved contour on a front face of the clearing bar, the first curved contour having an apex lying outside of the plane of the attachment neck, wherein a first tangent of the first curved contour at the apex is parallel to the plane of the attachment neck, and wherein a second tangent of the first curved contour at a point adjacent the apex penetrates the plane of the attachment neck; and (b) at least one attachment member for connection of the clearing bar to the clearing blade at the attachment neck of the clearing bar, the at least one attachment member extending in a forward direction of travel out of the plane of the attachment neck;

wherein the apex is at least aligned in a vertical manner with the at least one attachment member.

12. The clearing bar according to claim 11, wherein the apex is situated in front of the at least one attachment member.

13. The assembly according to claim 11, wherein the apex has a plumb point in the plane of the attachment neck, and wherein a first distance between the at least one attachment member and the plumb point is smaller than a second distance between the plumb point and an intersection point of the plane of the attachment neck and a lowermost plane of the clearing bar.

* * * * *